US007545250B2

(12) United States Patent
Reymann

(10) Patent No.: US 7,545,250 B2
(45) Date of Patent: Jun. 9, 2009

(54) ANCHORING MAGNET

(75) Inventor: Andreas Reymann, Mockanheim (DE)

(73) Assignee: Ratec Maschinenentwicklungs - und Verwaltungs-GmbH, Hockenheim (DE)

( * ) Notice: Subject to any disclaimer, the term of this patent is extended or adjusted under 35 U.S.C. 154(b) by 0 days.

(21) Appl. No.: 12/138,783

(22) Filed: Jun. 13, 2008

(65) Prior Publication Data

US 2008/0238597 A1 Oct. 2, 2008

Related U.S. Application Data

(62) Division of application No. 11/113,052, filed on Apr. 25, 2005.

(51) Int. Cl.
*H01F 7/20* (2006.01)

(52) U.S. Cl. ..... 335/285; 335/296; 335/297; 335/306

(58) Field of Classification Search ..... 335/285, 335/296–306
See application file for complete search history.

(56) References Cited

U.S. PATENT DOCUMENTS

| | | | | |
|---|---|---|---|---|
| 2,844,363 | A * | 7/1958 | Clark | 416/3 |
| 2,862,752 | A * | 12/1958 | Heppner | 292/251.5 |
| 3,419,832 | A * | 12/1968 | Baermann | 335/285 |
| 4,544,067 | A * | 10/1985 | Miller | 211/70.6 |
| 4,647,891 | A * | 3/1987 | Hughes | 335/302 |
| 4,810,987 | A * | 3/1989 | Liebthal et al. | 335/302 |
| 4,819,104 | A | 4/1989 | Dierkes et al. | |
| 4,842,460 | A | 6/1989 | Schlesch | |
| 4,899,894 | A * | 2/1990 | Crump | 211/70.2 |
| 6,050,931 | A * | 4/2000 | Russell | 600/15 |
| 6,380,833 | B1 * | 4/2002 | Nguyen et al. | 335/301 |
| 6,719,155 | B1 * | 4/2004 | Chang | 211/70.6 |
| 7,391,291 | B2 * | 6/2008 | Miyata | 335/302 |

FOREIGN PATENT DOCUMENTS

| | | | |
|---|---|---|---|
| BE | 756633 | | 3/1971 |
| DE | 1741733 | | 3/1957 |
| DE | 2935475 | A1 | 3/1981 |
| DE | 4424447.9-33 | | 7/1994 |
| DE | 19810612.2-33 | | 3/1998 |
| DE | 20105709.3 | | 3/2001 |
| EP | 199872 | A1 * | 11/1986 |
| FR | 2597933 | | 10/1987 |
| GB | 865502 | | 4/1961 |
| GB | 9411585.0 | | 7/1994 |
| JP | 356007410 | A | 1/1981 |

OTHER PUBLICATIONS

Patent Abstracts of Japan, Bd. 006, Nr 067 (E-104), Apr. 28, 1982 & JP 57007907.

* cited by examiner

*Primary Examiner*—Ramon M Barrera
(74) *Attorney, Agent, or Firm*—Berenato, White & Stavish

(57) ABSTRACT

An anchoring magnet for anchoring onto a magnetic or magnetizable substrate has a plurality of panel-shaped magnet elements extending in parallel fashion and panel-shaped pole elements extending parallel thereto. The magnet and pole elements are clamped alternatingly into an assemblage. The magnet elements have nonmagnetic protective layers. The protective layers are joined exclusively to the magnet elements.

10 Claims, 1 Drawing Sheet

Schnitt A-A

A
A

ANCHORING MAGNET

CROSS-REFERENCE TO RELATED APPLICATIONS AND CLAIM TO PRIORITY

This application is a division of U.S. application Ser. No. 11/113,052, filed Apr. 25, 2005, which is based upon utility model application number 20 2004 006 618.1, filed Apr. 26, 2004 in the Federal Republic of Germany, the disclosures of which are incorporated herein by reference and to which priority is claimed.

FIELD OF THE INVENTION

The invention concerns an anchoring magnet for anchoring onto a magnetic or magnetizable substrate, having a plurality of panel-shaped magnet elements extending in parallel fashion and panel-shaped pole elements extending parallel thereto, the magnet and pole elements alternating with one another and being clamped together into an assemblage forming the anchoring magnet, externally located end faces of the magnet elements being covered with protective layers.

BACKGROUND OF THE INVENTION

For the manufacture of finished concrete parts, formwork elements are placed onto steel tables and are retained in position by means of anchoring magnet devices placed on the steel table. An anchoring magnet device of this kind is known, for example, from DE 201 05 709 U1.

The anchoring magnets used for such anchoring magnet devices are constructed in plate fashion—i.e. are assembled alternatingly from a plurality of panel-shaped and rectangular magnet elements extending in parallel fashion and soft magnetic pole elements, likewise panel-shaped and rectangular, extending parallel thereto—and are clamped to one another to form an assemblage. Anchoring magnets of this kind are known, for example, from DE 44 24 447 and DE 94 11 585 U1. The pole elements project beyond the magnet elements usually on all end faces, but at least on the underside intended for placement onto the steel table, so that grooves whose bottoms are formed by the end faces of the magnet elements are produced between the pole elements.

The materials used for the magnet elements have little corrosion resistance. To protect them, DE 198 10 612 C2 proposes encapsulating the anchoring magnets in a plastic sheathing material forming a protective layer so that only the pole elements (and in fact only those on the underside of the anchoring magnet) are exposed, the anchoring magnet, and thus in particular the magnet elements, otherwise being completely enclosed. In a variant of this protective feature, only the above-described grooves between the pole elements are encapsulated with a plastic constituting a protective layer, thus protecting the magnet elements from corrosive influences.

Anchoring magnets of this kind rapidly become soiled with splashes of concrete, which adheres tenaciously to the anchoring magnet and is removed mechanically using steel brushes. The result is that the plastic protective layers are gradually removed, with the result that the corrosion-sensitive magnet elements become exposed and corrode.

Known in the existing art as an alternative thereto are anchoring magnets in which several magnet elements embodied as round disks are inserted loosely next to one another into matching receptacles of a protective frame, and the combination of protective frame and magnet elements is clamped between pole elements. The protective frame is made of aluminum or a plastic such as polyethylene. Manufacture of the protective frame is costly. In addition, circular magnetic elements arranged next to one another have poorer effectiveness than rectangular magnet elements.

A further problem is presented by the circumstance that anchoring magnets are required in different sizes. If the magnet elements are rectangular in shape, they must be individually adapted to the particular length of the anchoring magnet. Although this is not necessary in the case of circular magnet elements, the protective frame must nevertheless be equipped with a number of receptacles corresponding to the length of the anchoring magnet, i.e. in that respect once again an individual adaptation must be made. In both cases this results in considerable cost.

SUMMARY OF THE INVENTION

It is consequently the object of the present invention to create, in the context of an anchoring magnet of the kind cited initially, conditions such that anchoring magnets of different lengths can be manufactured at lower cost, and that the magnet elements can be reliably and permanently protected from corrosion.

This object is achieved, according to the present invention, in that the protective layers are joined exclusively to the magnet elements, i.e. are part of the magnet elements. The magnet elements are thus already provided with protective layers before assembly, and are clamped together with them between the pole elements. This opens up the possibility of standardizing the magnet elements, and implementing different anchoring magnet lengths by arranging several magnet elements of identical size next to one another in the longitudinal direction between two pole elements. In this fashion, a family of anchoring magnets of different sizes can be economically manufactured.

The material and thickness of the protective layers can be adapted to the particular application. In cases in which the protective layers are not subject to abrasive stress, thin protective layers made of a plastic such as polyethylene are sufficient. If the abrasive stress is high, for example caused by cleaning brushes, protective layers made of nonmagnetic metals, e.g. aluminum or special steel, or stainless steels such as V2A and V4A, are recommended. Hard plastics such as thermoset plastics are then also suitable.

The extension of the protective layers can also be adjusted in accordance with particular requirements. For example, the protective layers can completely encapsulate the magnet elements, e.g. by means of a thin plastic coating. Alternatively, however, provision can also be made to embody the protective layers as protective sleeves that enclose the magnet elements and cover the end faces of the magnet elements, thereby protecting them from external influences. The thickness and material of the protective sleeves can be adapted, as described above, to particular requirements.

The protective sleeves can be produced in such a way that they form a continuous protective ring. The latter can be endless. It can also, however, be manufactured so that the protective ring is formed by a protective strip whose ends overlap and are there joined to one another. In this case it is recommended to attach the overlapping ends to the associated magnet element, for example by spot welding or the like.

In a further embodiment of the invention, provision is made for the pole elements to have, on the sides facing toward the magnet elements, grooves that receive the magnet elements having the protective layers, preferably in zero-clearance fashion so that they are guided in the grooves and sealing is also achieved.

If the anchoring magnet has attachment means passing through it for clamping the pole elements together with magnet elements arranged next to one another, each magnet element should, at least in part, receive at least one attachment means. This can also be done, for example, in such a way that two magnet elements arranged next to one another together receive a respective attachment element on both sides, preferably supplementing one another in semicircular fashion.

BRIEF DESCRIPTION OF THE DRAWINGS

The invention is elucidated in more detail, with reference to an exemplifying embodiment, in the drawings, in which.

DETAILED DESCRIPTION OF THE PREFERRED EMBODIMENT(S)

Figures 1, 2, 3, 4, 5, 6:
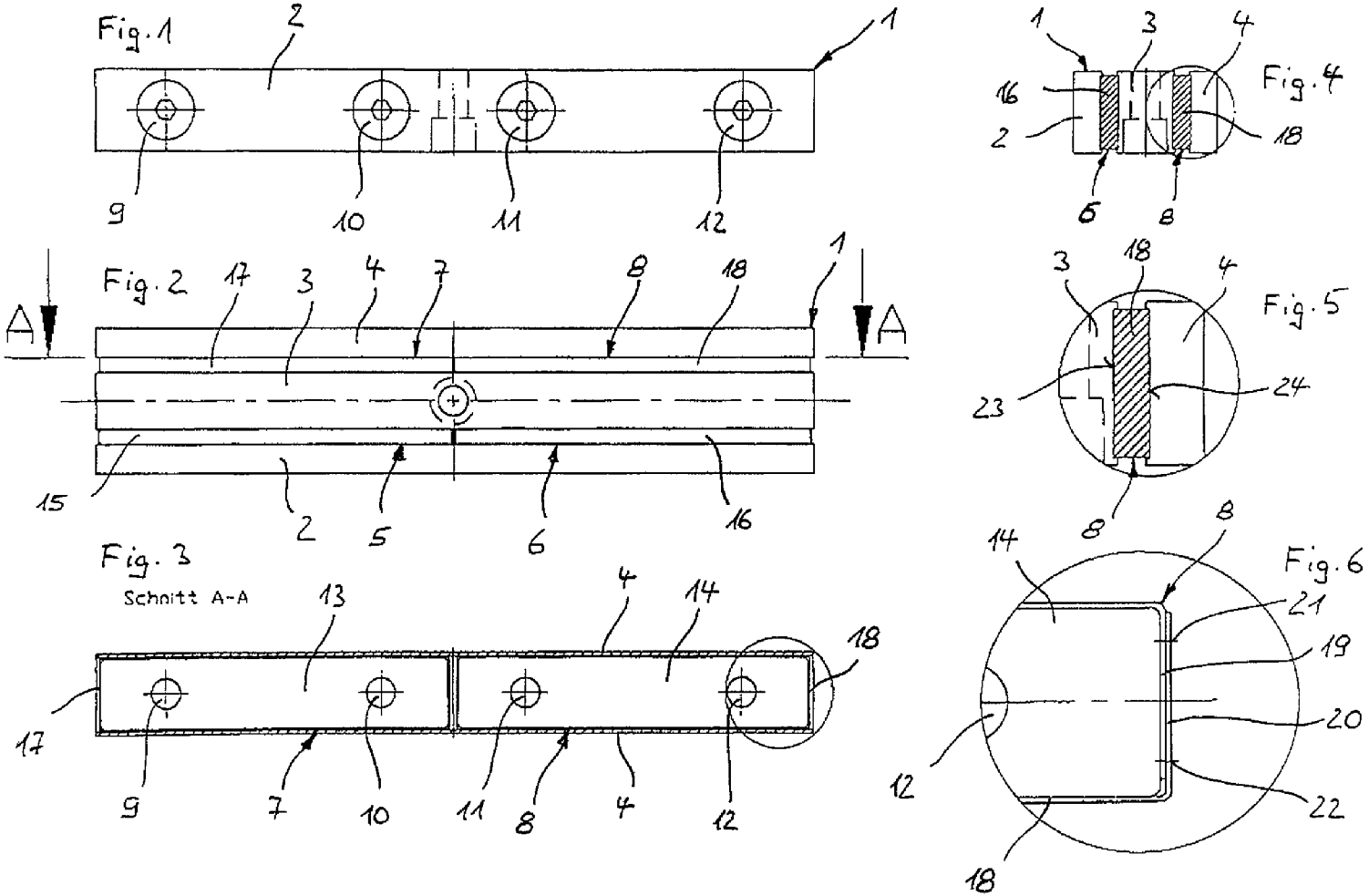
FIG. 1 is a side view of an anchoring magnet according to the present invention.
FIG. 2 is a plan view of the anchoring magnet according to FIG. 1.
FIG. 3 is a section in plane A-A through the anchoring magnet according to FIG. 2.
FIG. 4 is an end-on view of the anchoring magnet according to FIGS. 1 through 3.
FIG. 5 is an enlarged depiction of the detail circled in FIG. 4.
FIG. 6 is an enlarged depiction of the detail circled in FIG. 3, without pole elements.

Anchoring magnet 1 depicted in the Figures comprises three rectangular, panel-shaped pole elements 2, 3, 4 that are made of a soft magnetic material. Rectangular strip magnets 5, 6 and 7, 8 are arranged between pole elements 2, 3 and pole elements 3, 4, respectively, each two strip magnets 5, 6 and 7, 8 being arranged next to one another in the longitudinal direction of anchoring magnet 1. Passing through pole elements 2, 3, 4 and strip magnets 5, 6, 7 are bolts 9, 10, 11, 12 that clamp pole elements 2, 3, 4 and strip magnets 5, 6, 7, 8 against one another so that anchoring magnet 1 forms a solid assemblage.

Each of strip magnets 5, 6, 7, 8 comprises a magnet element 13, 14 (see FIG. 3) made of magnetic material, each of whose four end faces are completely covered by a protective ring 15, 16, 17, 18 so that each magnet element 13, 14 is surrounded on all sides by a respective protective ring 15, 16, 17, 18. The width of protective rings 15, 16, 17, 18 corresponds to the width of magnet elements 13, 14. Protective rings 15, 16, 17, 18 each comprise a protective strip having end portions 19, 20 (see FIG. 6), overlapping at a vertical end face, that are joined by spot welds 21, 22 to one another and to that end face of the associated magnet element 14.

As depicted particularly clearly in FIG. 5, longitudinal grooves 23, 24, which extend over the entire length of pole elements 2, 3, 4 and positively receive strips 5, 6, 7, 8 on the top and bottom, are shaped into pole elements 2, 3, 4, 5. The depth of longitudinal grooves 23, 24 is approximately half a millimeter. It is understood that such longitudinal grooves can also be shaped into pole elements 3, 4 that receive strip magnets 7, 8.

Protective rings 15, 16, 17, 18 protect magnet elements 13, 14 from corrosion. At the same time, they are sufficiently abrasion-resistant that they withstand repeated cleaning of the anchoring magnet even using steel brushes, so that magnet elements 13, 14 remain permanently protected from corrosion.

I claim:

1. An anchoring magnet (1) for anchoring onto one of a magnetic substrate and a magnetizable substrate, comprising:

a plurality of panel-shaped magnet elements (13, 14);

a plurality of nonmagnetic protective sleeves (15, 16, 17, 18), each of said protective sleeves (15, 16, 17, 18) joined exclusively to and enclosing a corresponding one of said magnet elements (13, 14);

a plurality of panel-shaped pole elements (2, 3, 4) extending in parallel fashion; and a plurality of grooves (23, 24) extending into said pole elements (2, 3, 4), said grooves (23, 24) extending in parallel fashion, wherein said magnet elements (13, 14) enclosed by said protective sleeves (15, 16, 17, 18) are disposed within said grooves (23, 24) so that said pole and magnet elements (2, 3, 4, 13, 14) are alternatingly arranged and extending in parallel to each other, and wherein said pole and magnet elements (2, 3, 4, 13, 14) are clamped together to form the anchoring magnet (1).

2. The anchoring magnet as defined in claim 1, wherein the protective sleeves (15, 16, 17, 18) are made of plastic or metal.

3. The anchoring magnet as defined in claim 1, wherein the protective sleeves completely encapsulate the magnet elements.

4. The anchoring magnet as defined in claim 1, wherein the protective sleeves each form a continuous protective ring (15, 16, 17, 18).

5. The anchoring magnet as defined in claim 4, wherein the protective rings (15, 16, 17, 18) are formed from a protective strip whose ends (19, 20) overlap and are there joined to one another.

6. The anchoring magnet as defined in claim 5, wherein the overlapping ends (19, 20) are attached to the associated magnet element (13, 14).

7. The anchoring magnet as defined in claim 1, wherein the grooves (23, 24) receive the protective sleeves (15, 16, 17, 18) in zero-clearance fashion.

8. The anchoring magnet as defined in claim 1, wherein between at least two pole elements (2, 3, 4), several magnet elements (13, 14) are arranged next to one another in longitudinal directions.

9. The anchoring magnet as defined in claim 8, wherein the anchoring magnet (1) has attachment means (9, 10, 11, 12) passing through it, and each magnet element (13, 14) positively receives, at least in part, at least one attachment means (9, 10, 11, 12).

10. The anchoring magnet as defined in claim 9, wherein two magnet elements arranged next to one another together receive an attachment element each on one side.

* * * * *

UNITED STATES PATENT AND TRADEMARK OFFICE

CERTIFICATE OF CORRECTION

PATENT NO. : 7,545,250 B2
APPLICATION NO. : 12/138783
DATED : June 9, 2009
INVENTOR(S) : Andreas Reymann It is certified that error appears in the above-identified patent and that said Letters Patent is hereby corrected as shown below:

Title page Item (75) Inventor should read: Andreas Reymann, Hockenheim (DE)

Signed and Sealed this

Eighteenth Day of August, 2009

David J. Kappos

David J. Kappos
*Director of the United States Patent and Trademark Office*